United States Patent [19]

Nicholson et al.

[11] 4,437,558

[45] Mar. 20, 1984

[54] COIN DETECTOR APPARATUS

[76] Inventors: Raymond Nicholson, 817 Industrial Dr., Elmhurst, Ill. 60126; Donald O. Parker, 1331 Phillips St., SW., Grand Rapids, Mich. 49507

[21] Appl. No.: 502,290

[22] Filed: Jun. 8, 1983

Related U.S. Application Data

[63] Continuation-in-part of Ser. No. 387,820, Jun. 14, 1982.

[51] Int. Cl.[3] ..... G07F 3/02

[52] U.S. Cl. ..... 194/97 R; 194/1 K

[58] Field of Search ..... 194/1 K, 97 R, 99, 100 R, 194/100 A

[56] References Cited

U.S. PATENT DOCUMENTS

| | | | |
|---|---|---|---|
| 2,589,214 | 9/1947 | Andrews | 194/100 R |
| 3,599,771 | 8/1971 | Hinterstocker | 194/100 A |
| 3,837,454 | 9/1974 | Joeck | 194/1 K |
| 4,298,116 | 11/1981 | Niemeyer | 194/97 R |

*Primary Examiner*—Joseph J. Rolla
*Assistant Examiner*—Yogi Beyer
*Attorney, Agent, or Firm*—Leydig, Voit, Osann, Mayer & Holt, Ltd.

[57] ABSTRACT

An electronically controlled coin tester which distinguishes between valid and invalid coins by subjecting both the token to be tested (test coin) and a fixed reference coin (sample coin) to similar magnetic fields and evaluating the quality of any null signals created by their combined output. A selectively shiftable coin holder is provided which serves to allow replacement of the sample coin as well as to provide a guiding ramp for the test coin which can be selectively set at various inclines dependant upon the size of the coins desired to be tested. The present device may optionally include a pendulum damper which will slow the movement of the test coin as its travels along the guiding ramp, and/or an antistringing device which prevents the removal of a coin from the coin box after acceptance.

7 Claims, 18 Drawing Figures

COIN DETECTOR APPARATUS

CROSS REFERENCE TO RELATED APPLICATION

This application is a continuation-in-part of U.S. application Ser. No. 387,820 filed June 14, 1982.

FIELD OF INVENTION

This invention relates to electronically controlled coin testing devices, and more particularly to an improved compactly arranged defeat-proof coin tester device.

BACKGROUND OF INVENTION

There are many, many kinds of coin operated devices and also many, many ways to attempt to cheat them. Several which come to mind are slugs, foreign coins, the retrievable coin-on-a-string, etc. As a result, there are many, many kinds of coin testing devices which attempt to discriminate between acceptable coins and those which are not.

The art is crowded with electrical, electronic and mechanical coin testing devices capable of fulfilling their purpose to a greater or lesser extent. Among the many approaches is the magnetic matching scheme described in Hinterstocker U.S. Pat. Nos. 3,599,771 and 3,741,363. Both patents deal with a three coil stack for creating a pair of magnetic fields in the two gaps between the three stacked coils. A sample coin is placed in one gap and a coin to be tested is passed through the second gap. Electronic circuitry monitors the magnetic fields to attempt to determine if the tested coin matches the sample coin using the attentuation characteristics of the coins as criteria.

The earlier issued patent describes a scheme whereby the testing electronics are switched on for only the brief instant when the coin is in test position. The later issued patent points out some of the problems with that approach and instead proposes a scheme which relies on sensing a null created when an acceptable coin passes through the magnetic field. Any coin which causes the system to null will be accepted unless the coin causes two nulls within a predetermined interval.

As commercially applied, the electronic coin tester described in those patents is used with a mechanical slug rejector, suggesting that the electronics does not do all of the testing.

In our co-pending U.S. application Ser. No. 387,820 filed June 14, 1982 there is disclosed a novel electronically controlled coin tester which needs no auxiliary mechanical devices, and which has superior selectability sensing not only the attentuation characteristics of the coins, but also the speed of travel of the tested coin.

As disclosed and claimed in our aforesaid application, the electronically controlled coin tester matches a tested coin against a sample coin held in a magnetic field by passing the test coin through a similar magnetic field to create a null in a detector coil sensing the fields. Electronic means monitors the duration and quality of the null as measures of the similarity of the coins and the magnetic field created with a spiked signal having a plurality of frequencies enhances selectability of the test coin.

Accordingly, it is an object of the present invention to provide an electronically controlled coin tester which enables matching a test coin against a sample coin in the aforementioned manner that permits the sample coin to be quickly and simply inserted and replaced. In this regard it is another object to provide an electronic coin tester of the foregoing type which can handle a wide range of coin diameters including the largest forms of coins circulated or used.

It is yet another object of the present invention to provide an electronically operated coin tester having provision to foil attempts to defeat the device by use of a proper coin on a wire or string.

Other objects and advantages will become apparent with reference to the following description when taken in conjunction with the drawings, in which.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
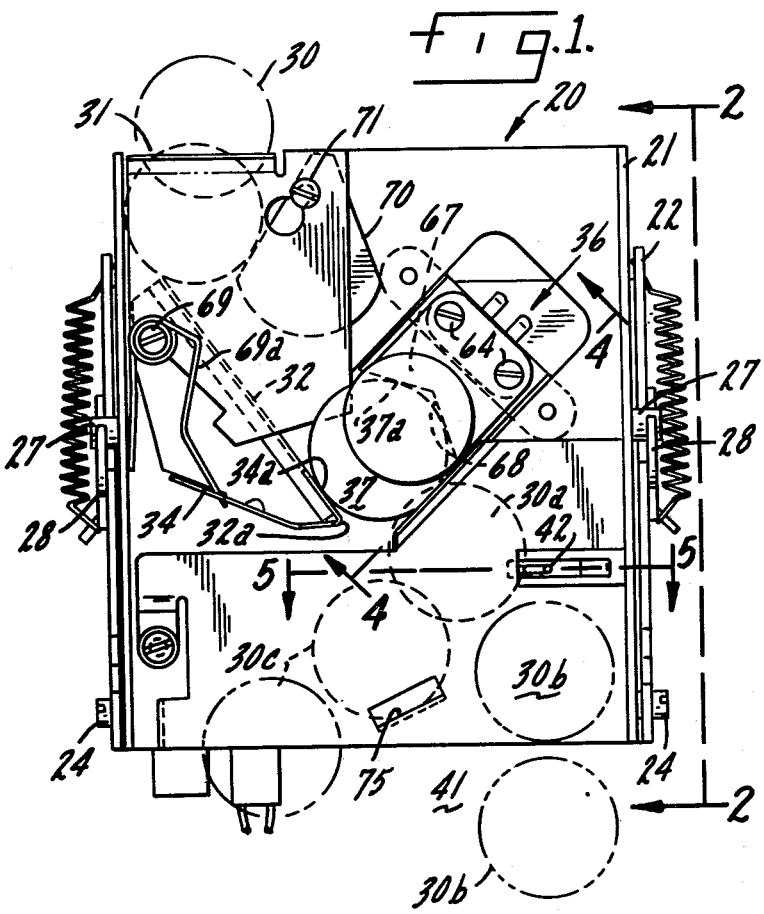
FIG. 1 is a front elevation showing an electronically controlled coin tester constructed in accordance with the present invention.
Figure 2:
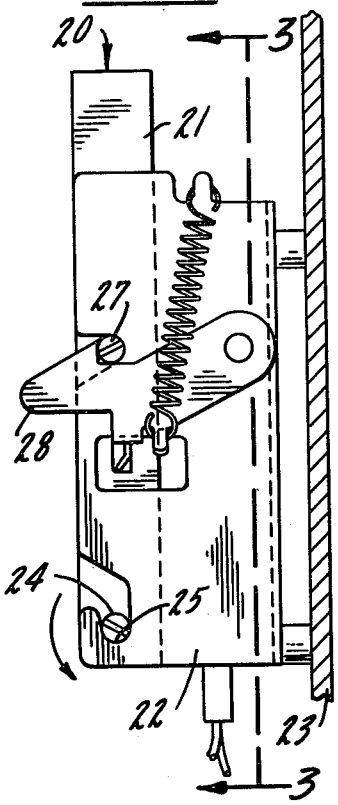
FIG. 2 is a side elevation of the coin tester of FIG. 1 taken along the line 2—2.
Figure 3:
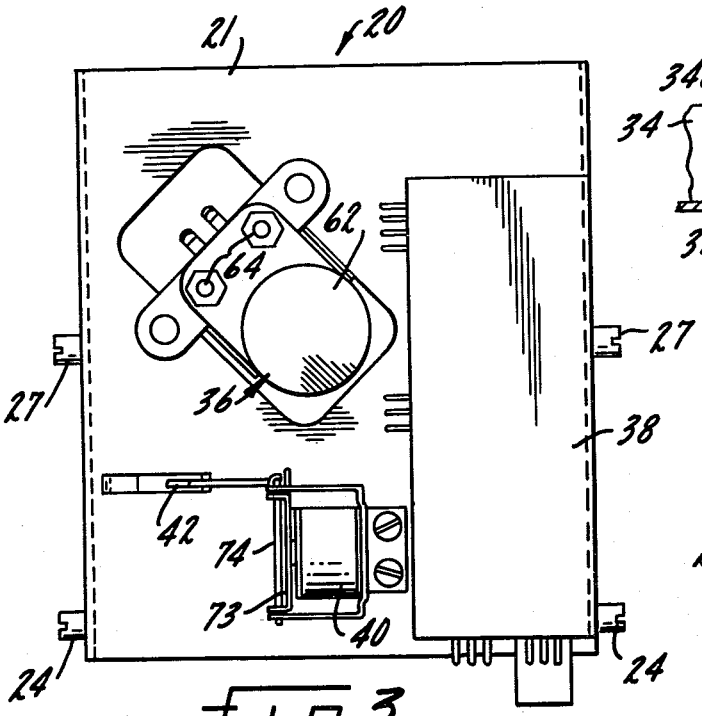
FIG. 3 is a partial rear elevation with back plate removed taken generally along the line 3—3 of FIG. 2.

Turning now to the drawings, and particularly to FIGS. 1–3, the major mechanical elements of the coin tester are illustrated. The coin tester 20 is built on a base plate 21 mounted for ready removal to a C-shaped mounting bracket 22 which in turn can be affixed to a convenient mounting surface 23 within a coin operated device. A pair of pins 24 on the base plate 21 are engaged in slots 25 in the mounting bracket 22. A further pair of pins 27 are engaged by spring loaded clamps 28 to firmly hold the base plate 21 on the C-shaped bracket 22. However, by simply depressing the spring loaded clamps 28, the base plate with its attached components can be removed to clear jams, make repairs or the like.

The tester 20 is adapted to receive a coin schematically illustrated at 30 from a coin chute (not shown) in a coin operated device (also not shown). The coin 30 enters a slot 31 in the coin tester and rolls down an incline 32 established by adjustable sample coin holder 34. As the coin rolls down the incline 32, it passes through a magnetic sensing assembly generally indicated at 36 at which point it is compared to a sample coin 37 held within the sensing assembly by the holder 34. Electronic circuitry within enclosure 38 serves to determine whether the test coin 30 matches the sample coin 37 in order to make a decision on whether or not to accept the coin. As the coin leaves the end portion 32*a* of the ramp 32, it follows a trajectory suggested by 30*a* toward a reject chute generally indicated at 41. If the coin characteristics did not match those of the test coin, the coin would simply follow the indicated trajectory suggested by phantom coins 30*b* and be returned to the depositor as unacceptable.

If, however, the electronics within the enclosure 38 determined that the characteristics of the test coin 30 matched the sample coin 37, electromagnet 40 would be energized moving a kicker arm 42 into the path of the coin 30 at about position 30*a*. The kicker arm 42 would thus prevent the coin from following the path previously illustrated as 30*b* and would instead cause the coin to follow the path suggested by 30*c*. The end result would be the deposit of the coin in the coin box and the operation of the machine in accordance with its normal function.

Figure 4:
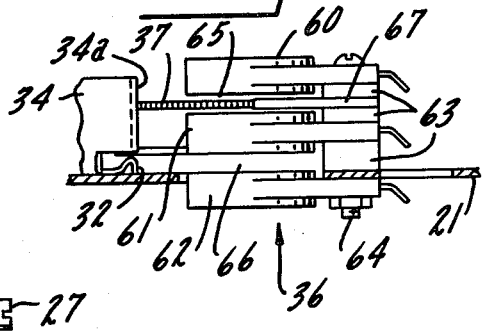
FIG. 4 is a partial sectional view showing the coil mechanism and coin holder taken along the line 4—4 of FIG. 1.

In carrying out the invention, the relationship between the sensing coil assembly 36 and the structure which holds the sample coin and guides the test coin is specially configured to produce a simple, serviceable and easily alterable coin mechansim while at the same time enhancing its ability to distinguish between acceptable and unacceptable coins. Referring to FIG. 4, there is shown the coil assembly 36 made up of three individual coils 60, 61 and 62 separated by spacers 63 and affixed at 64 to the base plate 21. Thus, two gaps 65, 66 are created between the coils in which are produced similar magnetic fields. In the gap 65, there is affixed a coin positioner 67 which defines a position for a portion of the periphery of the sample coin 37. As viewed in FIG. 1, the coin positioner 67 has a V-shaped face 68 which contacts a portion of the periphery 37*a* of the sample coin 37.

Cooperating with that structure is the pivotable coin holder 34, shown in FIG. 1 to be pivoted at 69 and spring loaded at 69*a* toward the V-shaped face 68 of the coin positioner 67. A surface 34*a* of the coin holder 34 engages the periphery of the sample coin 37 and forces it into the V-shaped notch 68, thus assuring it remains in a known position. Whenever it is desired to change a sample coin such as to make the machine operate for coins of a different denomination, it is simply necessary to pivot the holder 34 against its spring loaded pressure, remove the sample coin 37 and insert another. The center of the pivot point 69, the orientation of the V-shaped notch 68, and the location of the surface 34*a* are coordinated so that the coins having a reasonable range of diameters will be properly positioned within the slot 65 for comparison against test coins.

Returning to FIG. 4, it is seen that the slot 66 is provided for passage of the test coin through the magnetic sensors. The ramp surface 32 is formed metal section and is on the same level with and parallel to the sample coin holding the surface 34*a*, to establish a common plane for the two coins to be compared. Thus, as the test coin rolls along the ramp 32, it will pass through the slot 66 while penetrating into the magnetic field created in the slot by exactly the same amount as the fixed penetration of the sample coin 37 (assuming, of course, that the test coin matches the sample coin in size). Furthermore, when the mechanism is set up for a coin of different size, that relationship is retained by virtue of the common plane automatically achieved by the structure of the adjustable sample coin holder and test coin ramp.

It is important to note that the angle of the ramp 32 is dependent on the size of the coin being sought. If a device is used with coins smaller than those illustrated in the drawings, the ramp 32 becomes more horizontal, thereby causing the test coin to travel through the magnetic field at a slower rate.

As will be made clear in connection with the electronic elements, assuming the test and sample coins are the same, as the test coin passes through the magnetic field it will penetrate the field to the same extent as the sample coin. At that point, the electronics creates a null which is used to generate a signal to accept the coin. The time duration or width of the null is one of the criteria used for determining the acceptability of the test coin. The width of the null in turn is dependent not only on the degree of penetration (the diameter of the coin), but also on the speed of the coin. In order to achieve the same width null when using the coin tester for coins of different size it is therefore desirable to make coins of smaller diameter travel through the magnetic field more slowly.

In accordance with one aspect of the invention, that is accomplished by the privotable test coin holder 34 which establishes the common plane 32 for travel of the test coin. For coins of smaller diameter than those illustrated in FIG. 1, the ramp 32 becomes more horizontal and thus causes the smaller coins to travel more slowly through the magnetic field.

As a further aid in speed control, a pendulum damper 70 is pivoted at 71 to engage a coin as it begins its descent down the ramp 32. Since the pendulum 70 is fixed weight, its retarding effect on coins of larger diameter and thus larger mass will be less. As a result, smaller coins will be retarded to a greater extent than larger coins, further slowing the speed of travel of the smaller coin through the magnetic field.

The aforementioned mechanical features provide a coin tester which can be reset to operate with coins of a different denomination in a matter of seconds. It is simply necessary, to pivot the bracket 34 against spring force, allow the sample coin 37 to fall free, then replace the sample coin with the new sample coin, allowing the mechanism 34 to precisely locate the sample coin in its associated magnetic field while at the same time positioning ramp 32 at an angle optimized for speed control of the new sized coin.

Figure 5:
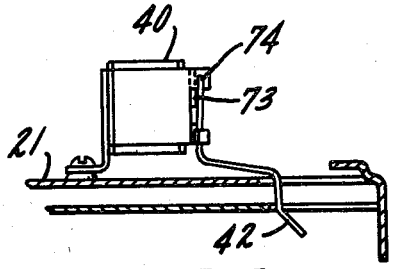
FIG. 5 is a partial sectional view showing the coin kicker taken generally along the line 5—5 of FIG. 1.

It was noted above that a kicker arm 42 controlled the flight of the coin after it left the ramp 32 into either the reject chute or the accept chute. Referring to FIGS. 3 and 5, it is seen that the kicker arm 42 is controlled by a solenoid 40. The solenoid has a plate 73 hinged at 74 to which the kicker arm 42 is fixed. The solenoid is normally de-energized such that any coin leaving the ramp 32 can brush the kicker arm 42 to its rightmost position as shown in FIGS. 1 and 5, thereby entering the chute. Whenever the electronics detects an acceptable coin within the magnetic field, the solenoid is operated, bringing the kicker arm to the position illustrated in FIG. 5, thus intercepting the coin as it leaves the ramp at about the 3:00 o'clock to 4:00 o'clock position as viewed in FIG. 1. As a result, the coin is deflected onto a ledge 75 which diverts it through the 30c positions into the coin box.

The common plane whose angle is determined by the size of the sample coin is also important in assuring that the kicker arm 42 engages the coin at about the preferred 3:00 to 4:00 o'clock position for consistently diverting it into the accept chute. Since the ramp 32 is pivoted toward the kicker arm for coins of decreasing diameter, coins smaller than those illustrated in FIG. 1 will leave the ramp 32 with a greater horizontal component which causes them to properly engage the kicker arm 42.

Figure 6:
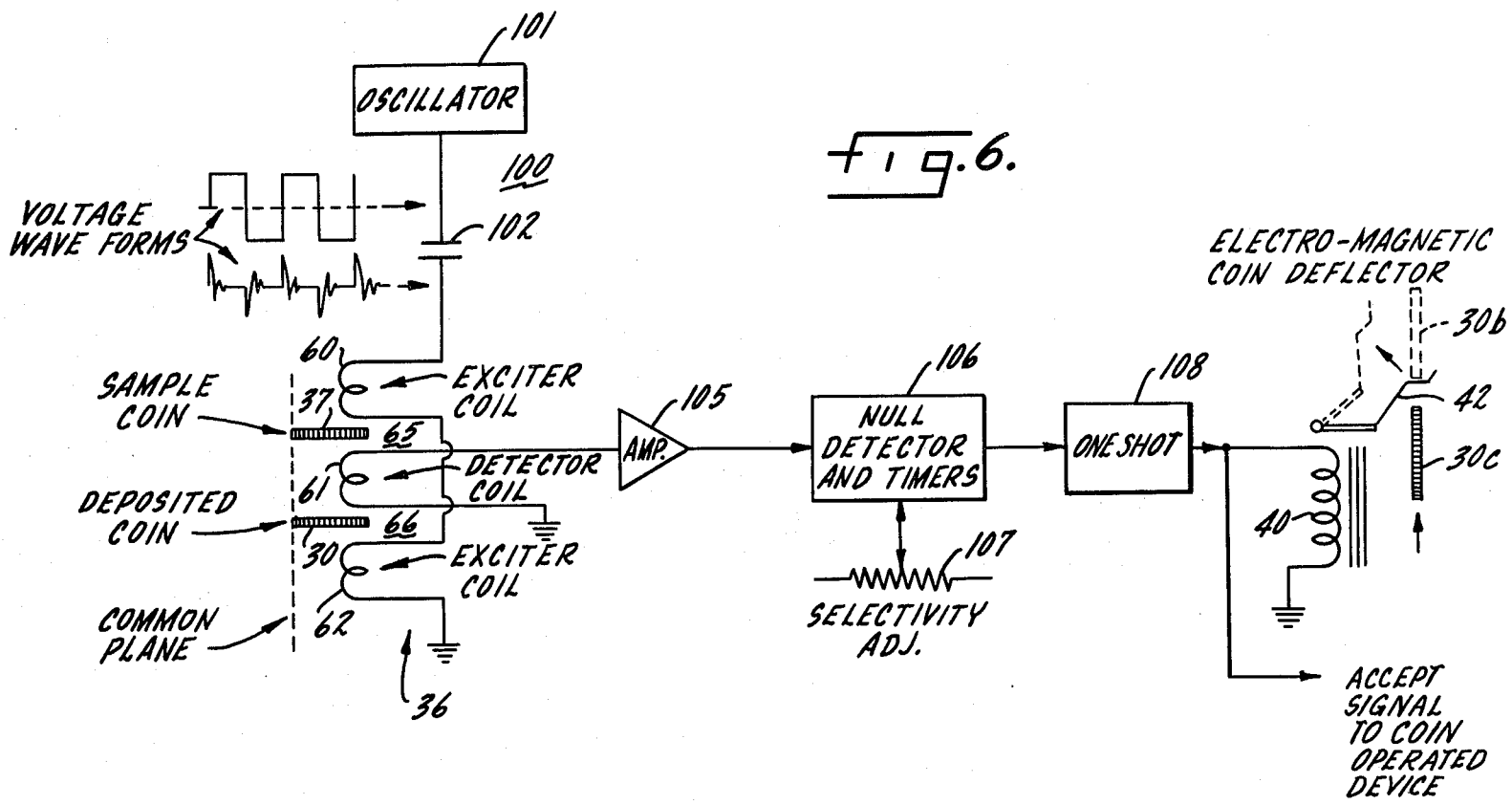
FIG. 6 is a block diagram illustrating one form of the electronics.

The electronic exciting and detecting circuitry is broadly outlined in the block diagram of FIG. 6. The coil assembly 36 is schematically illustrated to the left of the drawing and includes exciter coils 60 and 62 and central detector coil 61. The sample coin 37 is schematically illustrated in the gap 65 while a test coin 30 is schematically illustrated in the other gap 66. The exciter coils are connected in series to receive the output of a spiked signal source generally indicated at 100. In the illustrated embodiment, the spiked signal source is comprised of an oscillator 101 for producing a square wave voltage as illustrated, and means for differentiating the square wave comprising a capacitor 102 is connected in series between the oscillator and the exciter coils. The oscillator waveform before and after differentiation is illustrated in FIG. 6. It is seen that differentiation creates a spiked signal having a plurality of frequencies spanning the range to include what can be characterized as high frequencies and low frequencies. The low frequencies are at about the oscillator frequency which in one embodiment is selected at about 17 kilohertz, although obviously it can be varied over quite a wide range. The high frequencies are the actual spikes created by differentiating the edges of the square wave.

The multiple frequency signal is an important element in providing a tester capable of distinguishing coins of similar size but different material. It is found that some materials, typically those which are poor conductors such as lead attenuate higher frequencies to a greater extent than low frequencies, while other materials, typically good conductors such as silver attenuate in just the opposite fashion. Since the signal which drives the exciter coils has both high and low frequencies at different respective amplitudes, if a test coin of similar size but different material than the sample coin is passed through the magnetic field, in some portion of the frequency band it will be unable to attenuate the spiked signal to the same degree as the sample coin, and succeeding circuitry will respond to that by rejecting the coin.

As shown in FIG. 6, the central coil 61 is used as a detector coil, and the output is connected to an amplifier 105 which in turn feeds a null detector and timer arrangement 106. Associated with the block 106 is a selectivity adjustment 107 which can make the system more or less sensitive depending on the application.

With a sample coin in place and no test coin in the field, the detector coil 61 senses a large unbalance which drives the amplifier 105 to saturation. The amplifier output is actually following the spiked wave form coupled from the exciter coils to the detector coil, but the actual nature of the output depends on the material of the sample coin, as to whether primarily the high frequencies or low frequencies are reproduced. The null detector and timers 106 are insensitive to the large output from amplifier 105 in this quiescent mode.

When a test coin passes through the magnetic field in the gap 66, if it matches the sample coin, at some point during its travel it will create an interference in its gap 66 which matches the interference created by the sample coin 37 in its gap 65. As a result, the output of amplifier 105 will decrease toward zero as the null is approached and then return to its high quiescent level after the coin passes through. The null detector 106 senses that null and if its quality matches certain predetermined standards indicating the test coin matches the sample, it activates a one-shot multivibrator 108 to energize the solenoid 40 and draw the kicker 42 to the solid line position, thereby to deflect the coin into the coin box. In one embodiment of the invention, the one-shot 108 has a period of 50 milliseconds although that obviously can be varied to suit the circumstances. The output of the one-shot multivibrator 108 is also used as an accept signal for pulsing the coin operated device each time a coin is received in the coin box.

Figure 7:
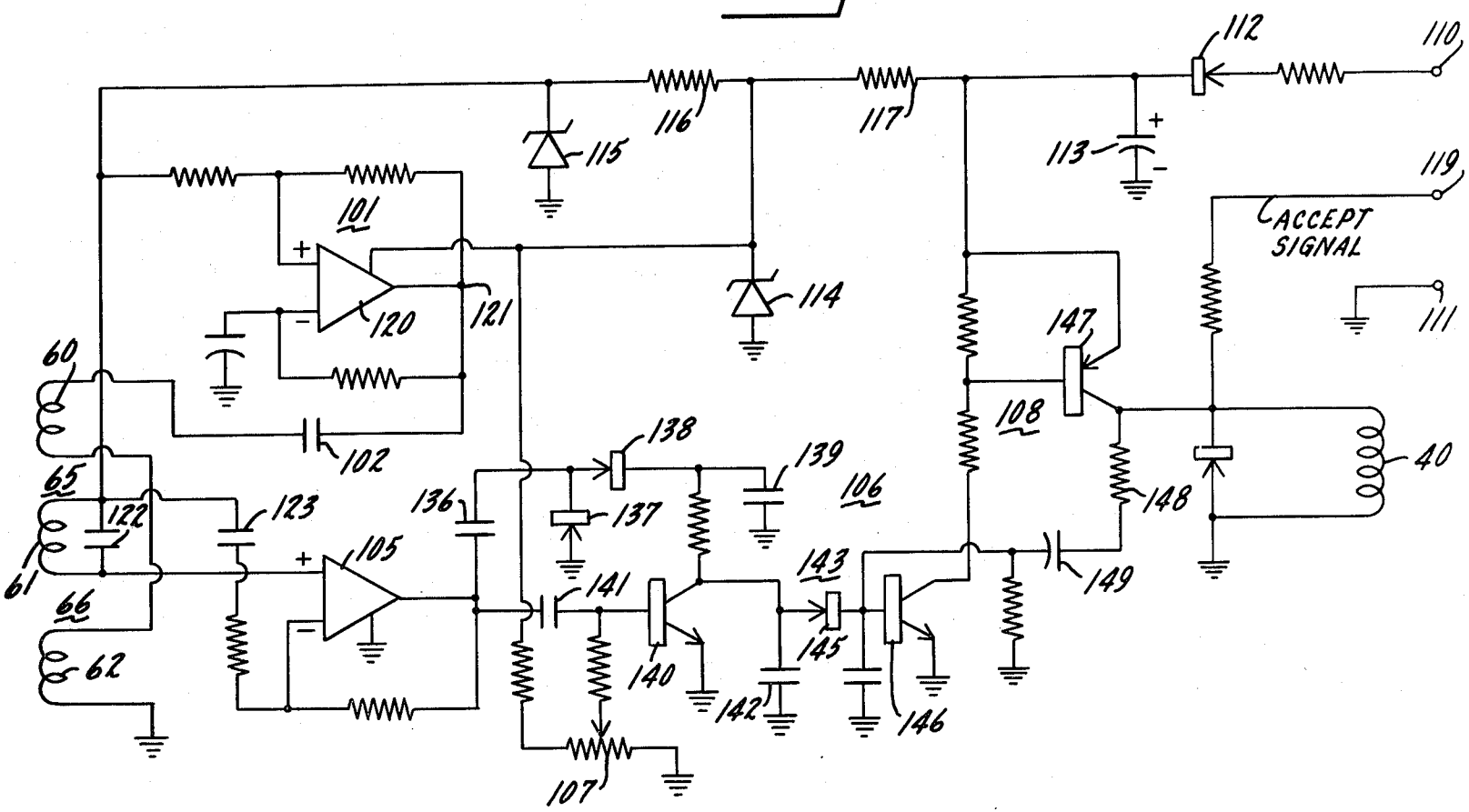
FIG. 7 is a circuit diagram detailing the electronics of FIG. 6.

The circuit diagram for an exemplary embodiment of the invention is illustrated in FIG. 7. A pair of terminals 110, 111 are connected to a suitable source of AC voltage, in one embodiment at 24 volts AC. The AC input is rectified by a diode 112 filtered by capacitor 113 and regulated by zener diodes 114, 115 and their associated dropping resistors 116, 117. In one embodiment zeners of 6 and 12 volt breakover voltage were used. The oscillator 101 is illustrated at the upper left of the drawing and includes conventional feedback elements to cause an amplifier 120 to produce a square wave output signal at 121 of 17 kilohertz in the illustrated embodiment. The differentiating capacitor 102 is shown connecting the amplifier output to the exciter coils 60, 62.

The detector coil 61 is magnetically coupled to the exciter coils 60, 62 via the magnetic fields in the gaps 65, 66. Some filtering is provided by a capacitor 122. The detector coil 61 thus serves to sense any difference in the magnetic fields in the gaps and couple a resulting signal by way of a capacitor 123 to the inverting input of the amplifier 105. The output of amplifier 105 thus is dependent on the balance or imbalance of the magnetic fields in the gaps 65, 66.

As noted above, with a sample coin in place and no test coin in place the output of amplifier 105 is driven to saturation because of the large imbalance. The null circuitry generally indicated at 106 treats that saturated condition as quiescent, and continues to monitor the amplifier to detect a null.

In accordance with the invention, the null detector circuitry 106 responds not only to the depth of the null, but also to its duration to provide superior selectivity. It is seen that the output of the amplifier 105 is connected through a capacitor 136 to a voltage doubler comprising diodes 137, 138 and a capacitor 139. Thus, in the quiescent condition when the output of amplifier 105 is switching very hard toward saturation in dependence on the high and/or low frequencies passed through the magnetic fields, the capacitor 139 is charged to its maximum level. However, as a test coin begins to enter the magnetic field, two things happen with respect to this portion of the circuitry. First of all, the circuit stops storing additional energy on the capacitor 139 as the output voltage of amplifier 105 begins to decrease. Secondly, the capacitor 139 actually begins to discharge as the null progresses. As will be described below, the energy stored in capacitor 139 is later used to trigger the circuitry which energizes the kicker magnet 40. Thus, if the null develops very slowly, there will not be sufficient energy left in capacitor 139 by the time the null reaches bottom to trigger the kicker and accept the coin. The circuitry acts as a form of timer and will reject any coin traveling below a predetermined rate down the common plane.

Returning to FIG. 7, it is seen that the capacitor 139 is connected in the collector circuit of a transistor 140 which has a base coupled through a capacitor 141 to the output of amplifier 105. In the quiescent condition when the output of amplifier 105 is switching hard into saturation, transistor 140 is also saturated. In that condition a capacitor 142 in the level sensing circuitry 143 remains discharged.

As noted above, when a test coin begins to pass through the magnetic field, the peak swing of the amplifier 105 begins to decrease as the system begins to enter a null. As a result, the voltage doubler stops charging capacitor 139. However, the amplifier signal is sufficient to keep switching transistor 140 into saturation. Actually, the transistor turns off briefly during each cycle of the spiked waveform, but the capacitor 142 prevents the collector from increasing in voltage. At any rate, when the system begins to enter the null, the capacitor 139 stops charging although the transistor 140 remains on. Thus, there is a path for capacitor 139 to discharge through resistor 144 and the collector-emitter of the transistor. That continues until the null reaches a low threshold level at which time the output of amplifier 105 will no longer be able to maintain transistor 140 conductive. At that time the energy remaining in capacitor 139 is available to charge capacitor 142 in the level sensing circuitry 143. If sufficient energy remains to charge capacitor 104 to a threshold of about 1.2 volts established by a diode 145 and the base-emittor junction of transistor 146, the transistor 146 in the one-shot multivibrator 108 will switch on. That in turn will switch on the transistor 147 and both will remain conductive for a predetermined interval determined primarily by the time constant of resistor 148 and capacitor 149. It is seen that the solenoid 40 for the kicker arm 42 is connected in the collector circuit of the transistor 147 and thus will be energized during the time the one-shot 108 is on. The transistor 148 also outputs the accept signal on terminal 119 to indicate to the coin operated device that a coin has been accepted.

For further information as to the operation of the circuitry, cross reference is made to our aforementioned application Ser. No. 387,820.

Figure 8:
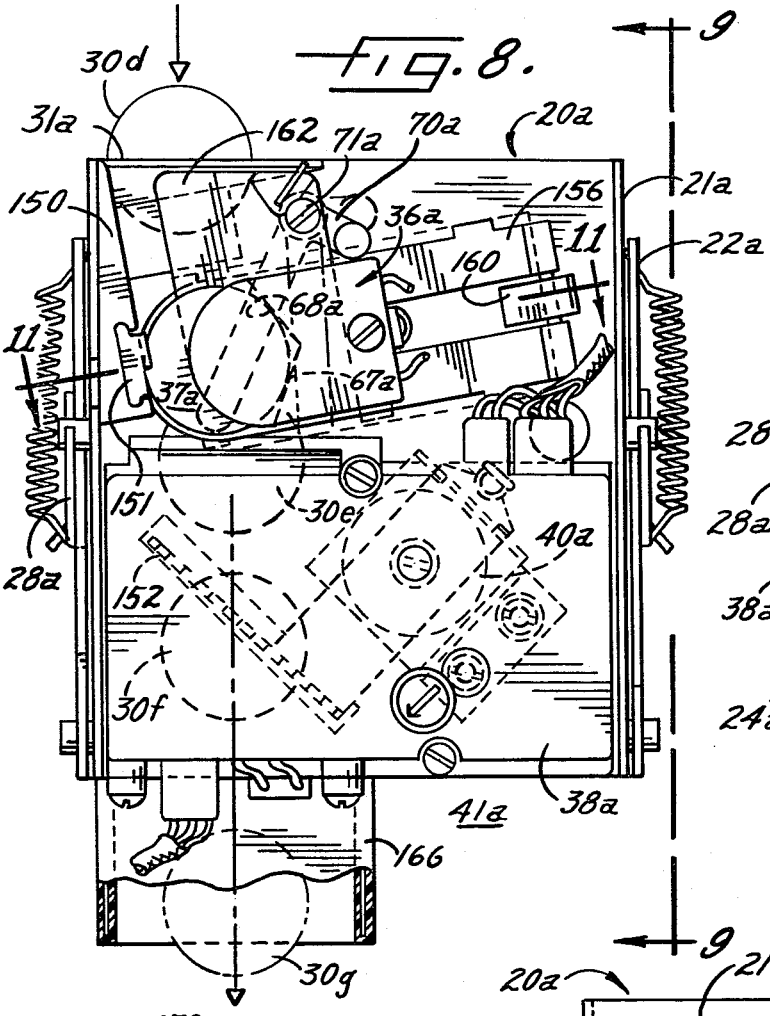
FIG. 8 is a front elevation showing an alternative embodiment of an electronically controlled coin tester constructed in accordance with the present invention.
Figure 9:
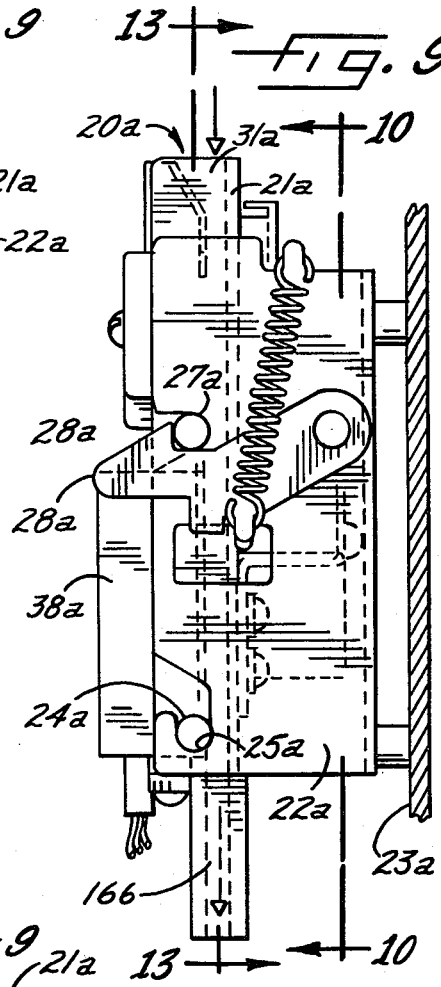
FIG. 9 is a side elevation of the coin tester of FIG. 8 taken along the line 9—9.
Figure 10:
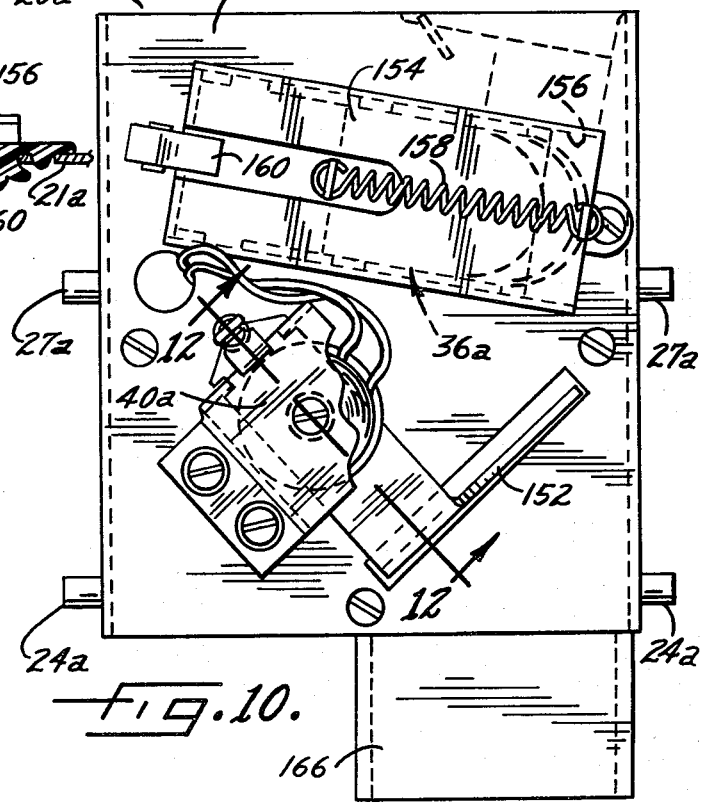
FIG. 10 is a partial rear elevation with the back plate removed taken generally the line 10—10 of FIG. 9.

Turning now to FIGS. 8–10, which illustrate the major mechanical elements of an alternative form of the coin tester of the present invention, for convenience, where the elements are the same as in the form illustrated in FIGS. 1–3 the same numbers have been used followed by the suffix "a". As in the previously described form, the coin tester **20*a* is built on a base plate 21*a* mounted for ready removal to a C-shaped mounting bracket 22*a* which in turn can be affixed to a convenient mounting surface 23*a* within a coin operated device. A pair of pins 24*a* on the base plate 21*a* are engaged in slots 25*a* in the mounting bracket 22*a*. A further pair of pins 27*a* are engaged by spring loaded clamps 28*a* to firmly hold the base plate 21*a* on the C-shaped bracket 22*a*. Simply depressing the spring loaded clamps 28*a*, enable the base plate with its attached components to be removed to clear jams, make repairs or the like. It will be appreciated by those skilled in the art that the conventionally utilized mounting bracket 22*a*** accepts either form of the present electronically controlled coin tester disclosed herein to replace previously utilized all mechanical coin tester devices.

Figure 12:
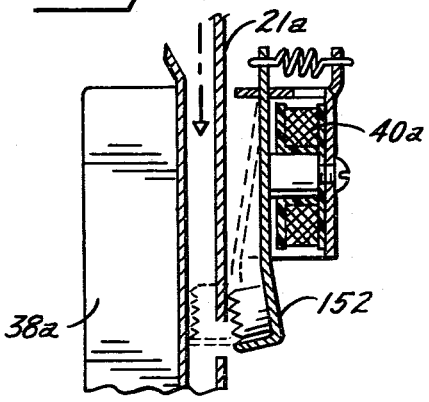
FIG. 12 is a partial sectional view showing the electromagnetic coin deflector taken generally the line 12—12 of FIG. 10.

The tester **20*a* is similiarly adapted to receive a coin schmetically illustrated at 30*d* from a coin operated device coin chute (not shown). As the coin 30*d* enters slot 31*a*, it rolls down along a wedge-shaped incline member 150 which includes a sample coin holding insert 151. The incline member 150 while stationary acts in the same manner as the pivoted coin holder of the previous embodiment in that it establishes a common plane to duplicate the field penetration of the test coin with that of the fixed sample coin. The rolling test coin passes through a magnetic sensing assembly generally indicated at 36*a* which serves to compare a sample coin 37*a* held between the sensing assembly and the wedge-shaped incline member 150. The electronic circuitry within enclosure 38*a* serves to determine whether the test coin 30*d* matches the sample coin 37*a* in order to make a decision on whether or not to accept the test coin. After the test coin passes through the magnetic sensing assembly, it continues downwardly as suggested by the phantom line coin showings 30*e* toward an electromagnetically operated toothed track member 152 normally disposed to present an incline in the downward path of the coin. If the test coin characteristics do match those of the sample coin, the electromagnet 40*a* would be energized moving the toothed track member 152 out of the path of the coin as best illustrated in FIG. 12 and the coin can continue on its downward path suggested by 30*f***. This path would permit the coin to continue to fall toward the coin box and result in operation of the machine in accordance with its normal function.

If, however, the electronics within the enclosure **38*a* determine that the characteristics of the test coin 30*d* do not match the sample coin 37*a*, the electromagnetic 40*a* would not be energized to move the toothed track member 152 out of the path of the coin 30*d* and the track member 152 then serves as a ramp to direct the coin towards a reject chute generally indicated at 41*a***.

In accordance with one of the important aspects of the invention, the relationship between the sensing coil assembly **36*a*** and the structure for holding the sample coin and guiding the test coin enables relative ease of changeover of sample coins and versatility in the sizes of coins which may be utilized as sample and test coins.

Figure 11:
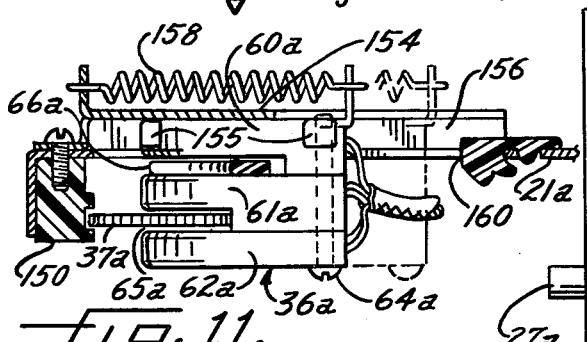
FIG. 11 is a partial sectional view showing the coil mechanism and coin holder taken along the line 11—11 of FIG. 8.
Figure 15:
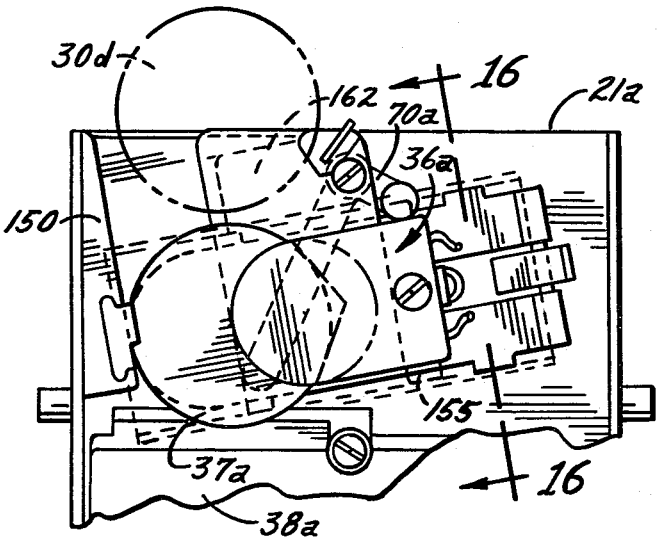
FIG. 15 is a fragmentary front elevation view showing the manner in which the coil mechanism and coin holder adjusts to accommodate large forms of sample coins and coins to be tested.
Figure 16:
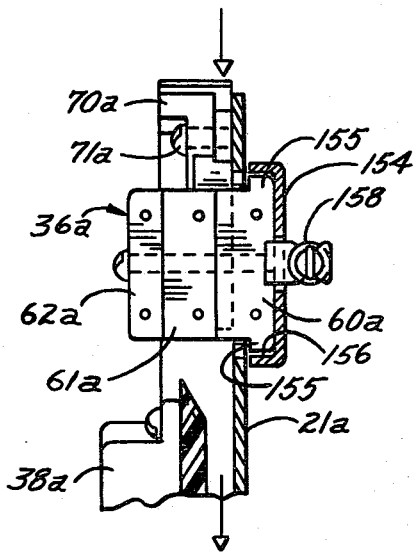
FIG. 16 is a partial sectional view taken along the line 16—16 of FIG. 15.

In the present form, referring to FIGS. 11, 15 and 16, the coil assembly **36*a* is made up of three individual coils 60*a*, 61*a* and 62*a* and fixed together at 64*a*. The rearmost coil 60*a* is encased in a generally rectangular member 154 (FIG. 16) having a pair of outwardly projecting tabs 155 which enable the coil housing to be slidably received and held in a pocket 156 formed in base plate 21*a*. A spring 158 acting between the coil assembly and base plate 21*a* normally pulls the coil assembly toward the wedge-shaped incline member 150 and allows the coil assembly to be shifted to the right as viewed in FIG. 8 to enable insertion of a sample coin 37***a* and to accommodate various diameters of sample coins. As viewed in FIG. 11, a stop member 160 pivotally held by the base plate 21*a* keeps the coil assembly 36*a* confined in the pocket 156, yet allows the entire coil assembly to be removed such as for replacement. The center coil 61*a* includes an encasement which has an upwardly projecting portion 162 (FIGS. 8 and 15) and carries the generally L-shaped pendulum damper 70*a* pivoted at 71*a* to engage a coin as it begins its descent through the opening 31*a*. In addition, with the present arrangement of the shiftable coil assembly 36*a* the inlet opening at the top is reduced with a smaller sample coin being held between wedge-shaped member 150 and the coil assembly 36*a* and the opening 31*a* enlarges with a larger sample coin 37*a* being held.

As in the earlier embodiment discussed, the present form includes a coin positioner 67*a* having a V-shaped face 68 in the sample coin gap which contacts a portion of the sample coin 37*a*. Whenever it is desired to change a sample coin such as to make the machine operate for coins of a different denomination, it is simply necessary to shift the coil assembly 36*a* against its spring 158, remove the sample coin 37*a* and insert another. The shiftable coil assembly arrangement permits accommodating coins, for example, as small as a U.S. dime and as large as 33 mm. which is about the maximum diameter of circulated coinage.

In accordance with another aspect of the present invention, a security detector coil 166 is positioned at the lower end of the acceptance chute. In connection with the electronic elements the security detector coil 166 serves as a verification of the receipt of a real coin to activate the coin operated device and it also provides a means for defeat of any attempt to use a real coin-on-a-string.

As will be made clearer in connection with the electronic elements description, referring to FIG. 8, assuming the test coin 30*d* and the sample coin 37*a* are the same, when the test coin passes through the magnetic field it will penetrate the field to the same extent as the sample coin. At that point, the electronics creates a null which is used to generate a signal to accept the coin. The time duration or width of the null is one of the criteria used for determining the acceptability of the test coin. The width of the null in turn is dependent not only on the degree of penetration (the diameter of the coin), but also on the speed of the coin. Here, the pendulum damper 70*a* provides the speed control by retarding coins of larger diameter as well as smaller diameter coins according to the coin mass necessary to overcome the counterweighted construction of the pendulum. Assuming that the electronics has detected an acceptable coin within the magnetic field, as indicated previously, the solenoid 40*a* is operated moving the toothed track 152 to the position illustrated in FIG. 12, and the test coin can continue on its downward path through the security coil 166 indicated at position 30*g*. The accepted test coin can then drop into the cash box.

The electronic circuitry is arranged so that upon an acceptable coin passing through the magnetic field of coil assembly 36*a*, a timed burst energizes the solenoid 40*a* for sufficient time to allow the passage of the coin and also sets up a magnetic field within coil 166. If the real coin passes through the field of security coil 166 it interrupts that field and the circuitry responds by turning on the machine and resetting itself to be prepared for testing of another coin.

Figure 13:
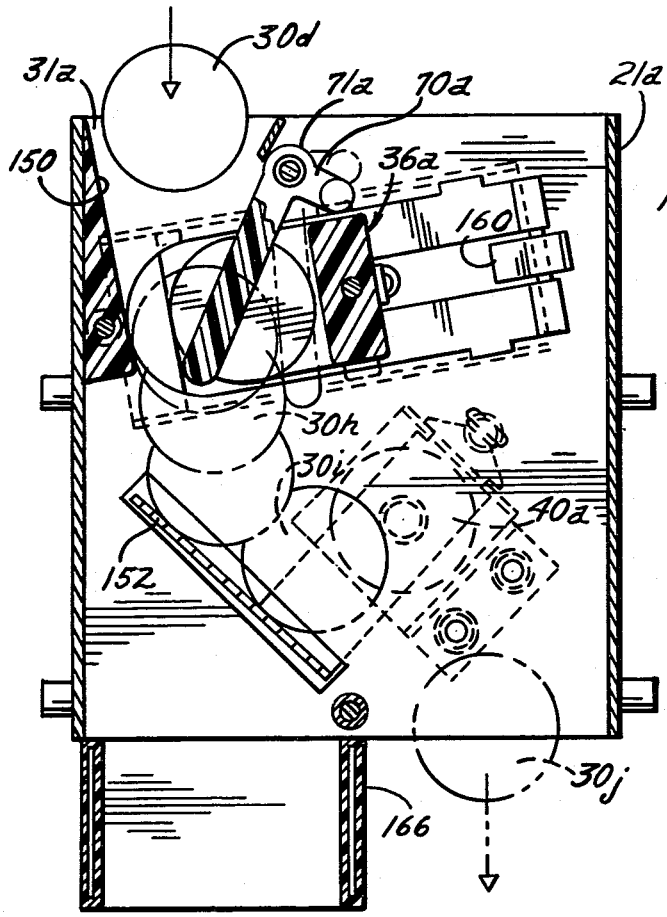
FIG. 13 is a sectional view taken along the line 13—13 of FIG. 9 here showing travel of a nonaccepted or rejected coin.

Referring to FIG. 13, there is illustrated the path of a coin 30*d* which is not found to be an acceptable coin within the magnetic field of coil assembly 36*a*. Since an unacceptable coin does not energize the solenoid 40*a* leaving the toothed track 152 in the path of the coin, illustrated as positions 30*h* and 30*i*, it strikes the track and rolls toward the rejection chute as shown at position 30*j*.

Figure 14:
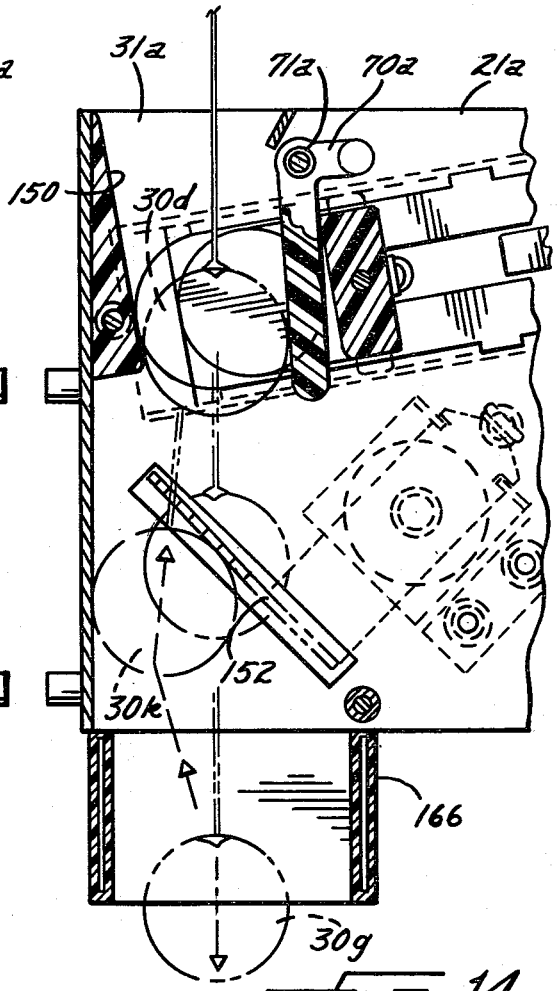
FIG. 14 is a sectional view similar to FIG. 13 here showing the path of an accepted coin and the manner in which the coin tester protects against defeat by a coin-on-a-string.

In keeping with the present invention as illustrated in FIG. 14, if a stringed real coin is presented to the detector, the operation will proceed as in accordance with the description with respect to a real coin in FIG. 8. Since the toothed track member 152 is only retracted for a predetermined time and then returns to the blocking position, any attempt to pull back the coin with a string causes it to engage the track member 152 as shown at 30*k*. Since the coin is trapped, pulling on the string or wire will break it loose from the coin which will then drop normally into the cash box. It will be appreciated that the instant arrangement not only eliminates any mechanical switching as a possible source of breakdown with extensive use, but the arrangement also minimizes space occupied by the coin detector apparatus to permit use of larger coin boxes in the coin operated device. If the stringed coin is continually held, it will maintain the interruption of the field and coil 166 and the detector will not permit acceptance of another coin until the blockage is removed.

Figure 17:
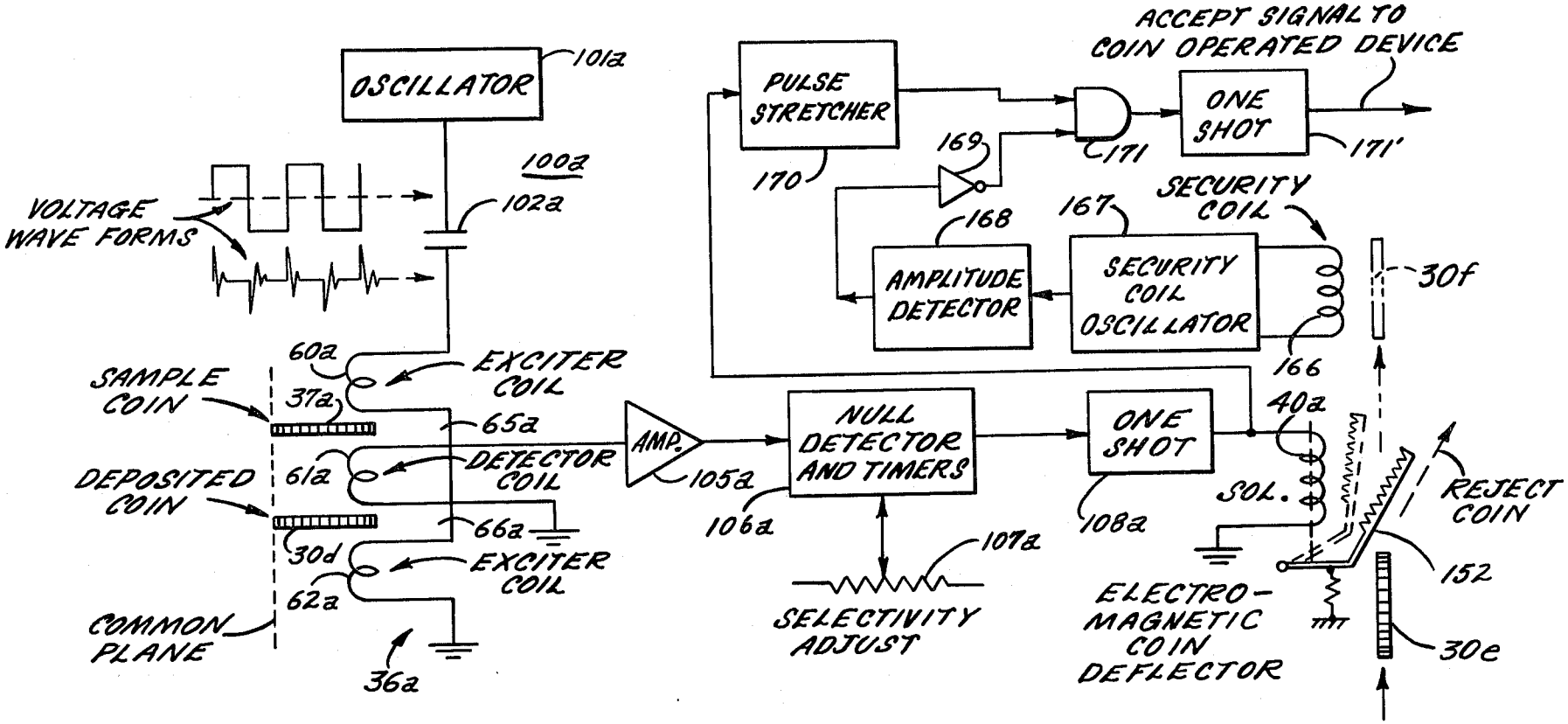
FIG. 17 is a block diagram illustrating the alternative form of the electronics.

Referring to FIG. 17, illustrating a block diagram of the electronic exciting and detecting circuitry, as in FIG. 6, the coil assembly 36*a* is schematically illustrated to the left of the drawing. The sample coin 37*d* as illustrated as held in the gap 65*a* between excitor coil 60*a* and central detector coil 61*a* while a test coin 30*d* is schematically illustrated in the gap 66*a* between excitor 62*a* and the central detector coil 61*a*. The excitor 60*a* and 62*a* are connected in series to receive the output of a spiked signal source generally indicated at 100*a*. The spiked signal source includes an oscillator 101*a* for producing a square wave voltage as illustrated, and means for differentiating the square wave comprising a capacitor 102*a* connected in series between the oscillator and the excitor coils. Again, as illustrated, that differentiation creates a spiked signal having a plurality of frequencies spanning the range to include what can be characterized as high frequencies and low frequencies.

The central coil 61*a* used as a detector coil has its output connected to an amplifier 105*a* which in turn feeds a null detector and timer arrangement 106*a*. In order to make the system more or less sensitive as may be desired, a selectivity adjustment 107*a* is provided in conjunction with the null detector and timer arrangement 106*a*.

The output of the null detector and timers is fed to a one shot 108*a* which generates a pulse for a coin reject solenoid 40*a*.

If the coin reject solenoid 40*a* is temporarily energized by the one shot 108*a*, the coin 30*e* passes to the position designated 30*f* and is detected by the security coil 166. The security coil 166 is energized by a security coil oscillator 167. The security coil 166 provides the inductance for the security coil oscillator 167 which is tuned to a high frequency. A coin 30*f* is sensed by dampening the radio frequency magnetic field in the security coil so that the security coil oscillator 167 is quenched. An amplitude detector 168 generates a logic high signal whenever the security coil oscillator is oscillating. The output of the amplitude detector 168 is fed to an inverter 169 which thereby generates a logic high whenever the security coil oscillator 167 is quenched, thus indicating the presence of the coin 30*f* in the vicinity of the security coil 166.

For further security, the accept signal to the coin operated device is activated only upon the coincidence of the one shot 108*a* being active and the coin being detected in the position 30*f* in the vicinity of the security coil 166. During the normal operation of the coin tester, an accept signal could be generated whenever the security coil 166 detects the presence of a coin 30*f*. It is possible, however, that a stringed coin could be dangled in such a fashion as to generate successive signals from the security coil 166. To prevent a dangled coin from generating multiple accept signals, the output of the one shot 108*a* is stretched for a sufficient time by a pulse stretcher 170 so as to be present at the time that the security coil 166 first senses the presence of the coin 30*f*. The accept signal is generated only by the coincidence of the stretched one shot pulse and the output of the inverter 169 indicating that the security coil oscillator 167 is quenched. An AND gate 171 combines the output of the pulse stretcher 170 and the inverter 169, and the output of the AND gate triggers a one shot 171' to generate the accept signal to the coin operated device. In other words, the accept signal to the coin operate device is active only when the security coil 166 detects the presence of the coin 30*f* within a predetermined time after a null of predetermined quality is detected by the detector coil 61*a* and null detector and timers 106*a*.

Figure 18:
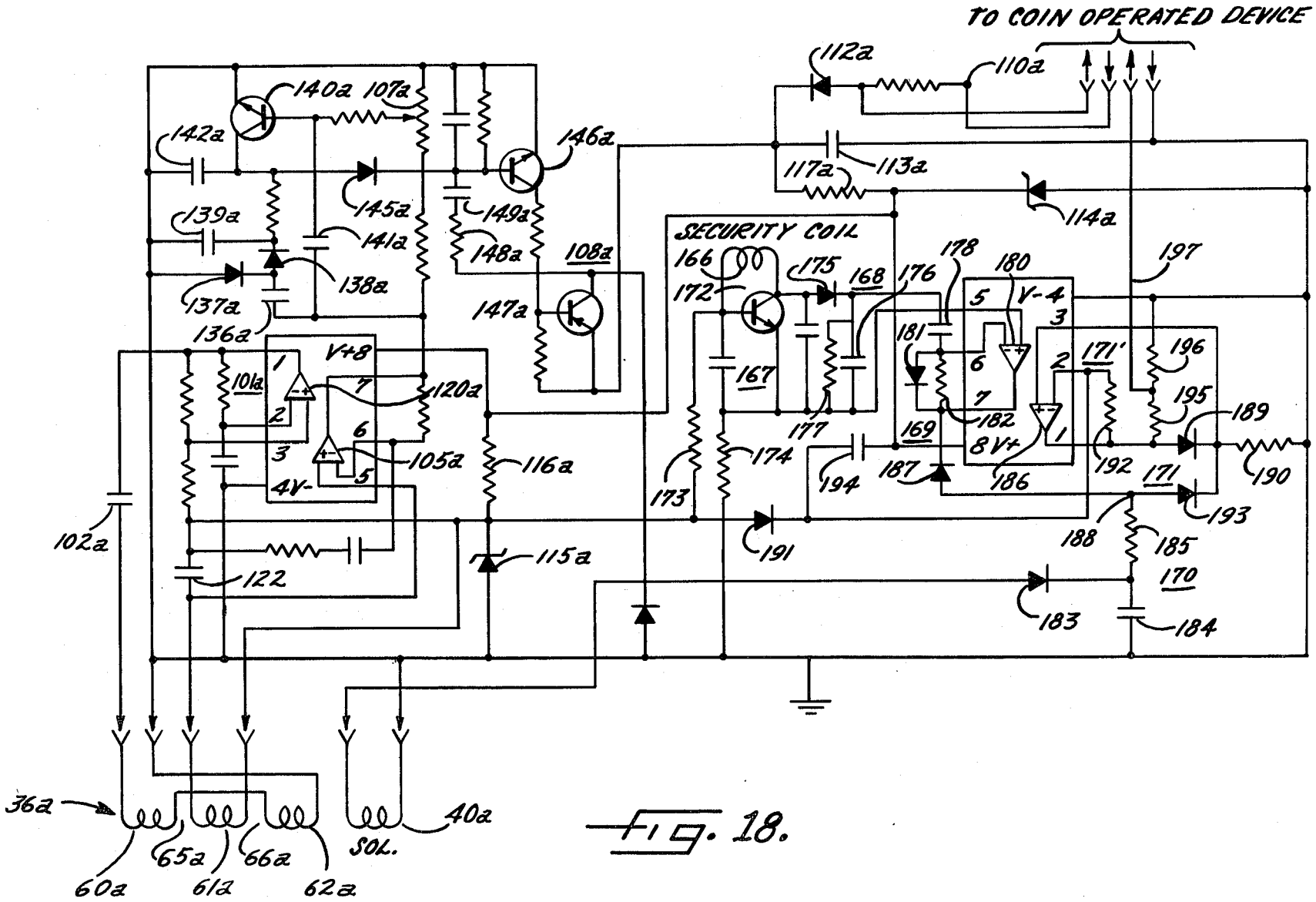
FIG. 18 is a circuit diagram detailing the electronics of FIG. 17.

In FIG. 18, there is shown a schematic diagram of the preferred circuit corresponding to the block diagram of FIG. 17. The circuits for the oscillator 101*a*, the amplifier 105*a*, the null detector and timers 106*a*, and the one shot 108*a*, are substantially the same as shown in FIG. 7. Similar components are shown with the same reference numbers to which a small letter a is appended. The security coil oscillator 167 uses an NPN transistor 172 as its active device. The base and emitter of the transistor 172 are at a bias voltage level between ground and the mid-supply voltage set by the zener 115*a*. The bias point is set by resistors 173 and 174. The voltage on the emitter of the transistor 172 is in effect signal ground for the security coil oscillator 167, the amplitude detector 168, and the inverter 169. In the absence of a coin 30*f* near the security coil 166, there is sufficient positive feedback from the collector to the base of the transistor 172 so that a high frequency alternating voltage is generated on the collector of the transistor 172. This alternating potential is rectified by a diode 175 in the amplitude detector 168 and a capacitor 176 is charged up to the amplitude level. If a coin 30*f* is in the vicinity of the security coil 166, however, energy is absorbed by the coin 30*f* so that the oscillator 167 is quenched. The diode 175, in other words, no longer has an alternating potential to rectify. A resistor 177 is provided to discharge the capacitor 176 thereby generating a negative-going pulse which is fed to the inverter 169 through an AC coupling capacitor 178.

The inverter 169 uses an operational amplifier 180 as an active element. The operational amplifier 180 is biased by having its positive input tied to the emitter of the security oscillator transistor 172. A diode 181 and resistor 182 provide negative feedback from the output of the operational amplifier 180 to its minus input so that the output of the operational amplifier is normally at a level significantly below the bias set by the zener diode 115*a*, but when the security coil oscillator 167 is quenched, an output pulse rises to the positive supply level of the operational amplifier.

The pulse stretcher 170 is merely a diode-capacitor peak detector comprising a diode 183 and a capacitor 184. The predetermined time limit of the pulse stretcher 170 is set by the value of the capacitor 184 and the value of a resistor 185. This time constant is on the order of 200 mS representing the maximum time for the coin to travel from the exciter and detector coils 36*a* to the security coil 166 and for the amplitude detector 168 to respond the the quenching of the security coil oscillator 167.

A logical and function 171 is provided by diode logic. A directional ciode 187 combines the output of the inverter 169 and the output of the pulse stretcher 170 at a summing node 188. The potential at the summing node 188 is a logical low unless both the output of the inverter 169 is high and the capacitor 184 is still charged by a previous pulse from the one shot 108*a*. The logic level at the summing node 188 is sensed and converted to an accept signal of a predetermined pulse width by an operational amplifier 186 and its associated components which form the one shot multivibrator 171'. The output of the operational amplifier 186 is normally low, with the positive feedback diode 189 in a nonconductive state. The positive input to the amplifier 186 is thus held low by a resistor 190 tied to ground. The negative input to the operational amplifier 186 is held at a mid-supply value by a diode 191 and a resistor 192 tied to the output of the operational amplifier 186.

When the one shot 171' is in its initial state as described above, it is ready to be triggered by a logic high level on the summing node 188. The high level forward biases a diode 193 to its conductive state and thus turns on the operational amplifier 186 via a high logic level on the positive input of the operational amplifier. Even if the level at the summing node 188 thereupon goes low, the operational amplifier 186 is held in its on state by the positive feedback diode 189. During this time, however, the diode 191 becomes reverse biased as a capacitor 194 becomes charged through the resistor 192. The capacitor 194 in fact becomes charged up to the high output level of the operational amplifier 186 which is one diode drop higher, by virtue of the diode 189, than the voltage level on the positive input of the amplifier 186. Hence, the operational amplifier 186 will turn off when the voltage on the capacitor 194 and the negative input of the operational amplifier becomes greater than the voltage on the positive input of the operational amplifier. Hence, the multivibrator 171' returns to its off or untriggered state a predetermined time after being triggered, the predetermined time being set by the time constant of the resistor 192 and the capacitor 194. The output of the one shot is used as an accept signal to the coin operated device and a voltage divider comprising a resistor 195 and 196 sets the desired output logic swing on the output line 197 to the coin operated device.

From the foregoing, it is seen that the coin tester of the present invention matches a test coin against a sample coin and permits the sample coin to be quickly and simply inserted and replaced. The coin tester accepts a wide range of coin diameters including the largest forms of coin circulated or used. The coin tester also has provisions to foil attempts to defeat the device by the use of a proper coin on a wire or string. The coin is in fact tested twice, both before and after a tooth track disposed in the coin's path to the coin box. The tooth track prevents the withdrawal of a stringed coin from the coin box.

We claim:

1. In a coin tester for comparing a test coin to a sample coin, including coil assembly means for creating a magnetic field, means for locating the sample coin within the magnetic field, means for passing the test coin through the magnetic field, and means for evaluating the quality of the null created by the test coin as it passes through the magnetic field, the improvement comprising, single coin holder locating means for establishing a position for a portion of the periphery of the sample coin, means associated with the locating means and the coil assembly for relatively moving the holder and coil assembly to insert a sample coin and hold the sample coin in a predetermined position, the sample holder means having a ramp surface for guiding the test coin through the magnetic field, the angle of the ramp surface being the same as for the sample coin, thereby to cause the test coin to enter the magnetic field to the same extent as the sample coin.

2. The improvement as set out in claim 1 wherein there is further provided a pendulum damper for engaging the test coin prior to its entry into the magnetic field, said pendulum damper so constructed and arranged as to provide a variable retarding force dependent on coin size.

3. The improvement as set out in claim 1 wherein the sample coin holder is pivotal and so constructed and arranged as to decrease the angle of the ramp for test coins of decreasing diameter thereby to cause smaller coins to travel through the magnetic field slower than larger coins.

4. The improvement as set out in claim 1 wherein the coil assembly shifts relative to the sample coin holder to increase and decrease the accommodated diametral size of sample coins used to match with test coins.

5. The improvement as set out in claim 1 wherein there is further provided means for directing coins, having passed through the magnetic field, to a reject chute unless a null of predetermined quality is detected by the means for evaluating, said means for directing having a tooth track normally blocking the path from the magnetic field to a coin box, the tooth track being temporarily removed from the path upon the detection of a null of a predetermined quality by the means for evaluating so that stringed coins are entrapped in the coin box and their removal is blocked by the tooth track.

6. The improvement as set out in claim 5 further comprising means for detecting whether a coin has passed the tooth track on the path to the coin box.

7. The improvement as set out in claim 6 further comprising means for generating a coin acceptance signal if a coin passes the tooth track on the path to the coin box within a predetermined time after a null of predetermined quality is detected by the means for evaluating.

* * * * *

UNITED STATES PATENT AND TRADEMARK OFFICE

CERTIFICATE OF CORRECTION

PATENT NO. : 4,437,558

DATED : March 20, 1984

INVENTOR(S) : Raymond Nicholson

It is certified that error appears in the above-identified patent and that said Letters Patent is hereby corrected as shown below:

At column 4, line 43:

Delete "privotable" and insert -- pivotable --;

At column 12, line 15:

Delete "and" and insert -- end --;

At column 12, line 16:

Delete "ciode" and insert -- diode --;

At column 12, line 13:

Delete "the", first occurrence, and insert -- to --.

Signed and Sealed this

Twenty-fourth Day of August, 1993

Bruce Lehman

*Attest:*

BRUCE LEHMAN

*Attesting Officer*

*Commissioner of Patents and Trademarks*